US012245675B1

(12) United States Patent
Scott-Daity et al.

(10) Patent No.: US 12,245,675 B1
(45) Date of Patent: Mar. 11, 2025

(54) FINGERNAIL DRYER

(71) Applicants: Dena Scott-Daity, New York, NY (US); Anthony Cullington, New York, NY (US)

(72) Inventors: Dena Scott-Daity, New York, NY (US); Anthony Cullington, New York, NY (US)

( * ) Notice: Subject to any disclaimer, the term of this patent is extended or adjusted under 35 U.S.C. 154(b) by 685 days.

(21) Appl. No.: 17/524,115

(22) Filed: Nov. 11, 2021

(51) Int. Cl.
*A45D 29/18* (2006.01)
*A45D 29/22* (2006.01)

(52) U.S. Cl.
CPC ..... *A45D 29/18* (2013.01); *A45D 29/22* (2013.01)

(58) Field of Classification Search
None
See application file for complete search history.

(56) References Cited

U.S. PATENT DOCUMENTS 5,249,367 A 10/1993 Nafziger et al.
8,739,431 B2 6/2014 Cheng
2006/0260628 A1* 11/2006 Chan ..... A45D 29/00 132/73

FOREIGN PATENT DOCUMENTS

CN 208770374 U * 4/2019
KR 101560360 B1 * 10/2015
WO WO-2018016040 A1 * 1/2018

* cited by examiner

*Primary Examiner* — Jason Lau
(74) *Attorney, Agent, or Firm* — Sanchelima & Associates, P.A.; Jesus Sanchelima; Christian Sanchelima

(57) ABSTRACT

A fingernails dryer including a housing assembly, a door assembly and an electrical assembly is disclosed herein. The housing includes a housing having vents, a first receptacle and a second receptacle. The vents include a cavity. The housing further includes a plurality of channels to receive fingers of a user. The door assembly includes a door being hingedly attached to the housing. The electrical assembly includes a plurality of lights, a fan and a dial. The dial allows to choose a dyer mode. A first dryer mode includes the plurality of lights being disposed on the door and are directed towards the fingernails of a user. A second dryer mode includes a fan mounted to the cavity to blow air to the first receptacle and the second receptacle.

1 Claim, 3 Drawing Sheets

FINGERNAIL DRYER

II. BACKGROUND OF THE INVENTION

1. Field of the Invention

The present invention relates to a fingernail dryer and, more particularly, to a fingernail dryer that is configured to dry the fingernails of a user.

2. Description of the Related Art

Several designs for fingernail dryers have been designed in the past. None of them, however, include receptacles configured to receive only the finger tips of a user.

Applicant believes that a related reference corresponds to U.S. Pat. No. 5,249,367 issued to for a nail drying apparatus for receiving both hands. Applicant believes that another related reference is 8,739,431 issued for a light solidifying device having a magnetic sliding cover and UV LEDs for curing nail polish. None of these references, however, teach of a fingernail dryer that includes a plurality of UV LEDs mounted to a door of the fingernail dryer, wherein the UV LEDs are directed toward the user's fingernails.

Other documents describing the closest subject matter provide for a number of more or less complicated features that fail to solve the problem in an efficient and economical way. None of these patents suggest the novel features of the present invention.

III. SUMMARY OF THE INVENTION

It is one of the objects of the present invention to provide a fingernails dryer that includes a hinged door including UV LEDs directed towards a user's fingernails to kill germs without damaging skin of the user.

It is another object of this invention to provide a fingernails dryer that includes a vent system to blow air to the fingernails for drying.

It is still another object of the present invention to provide a fingernails dryer that includes a motorized hinged door that can be automatically closed when detecting user's hand.

It is yet another object of the present invention to provide a fingernails dryer that includes a display and a dial for setting duration and mode for the fingernails dryer.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

Figure 1:
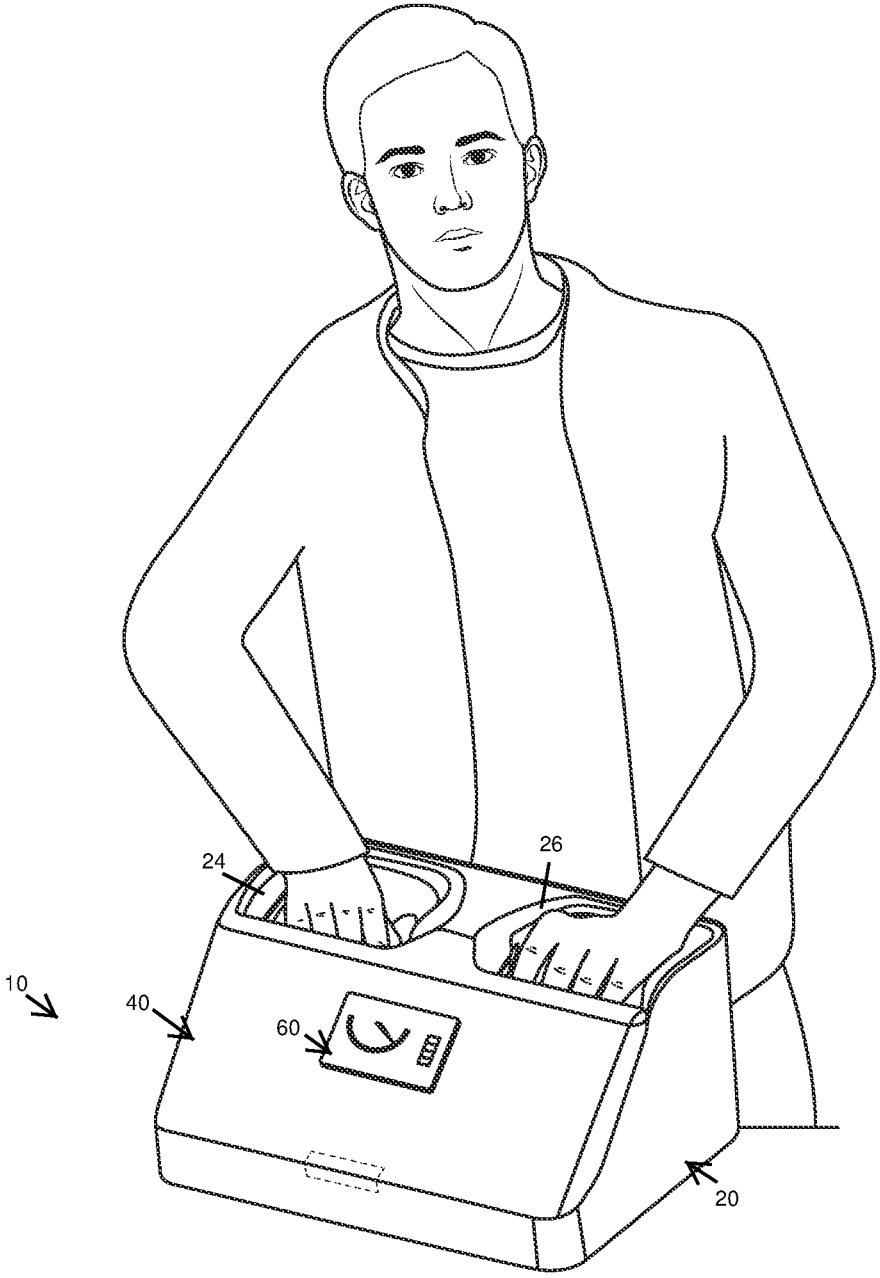

With the above and other related objects in view, the invention consists in the details of construction and combination of parts as will be more fully understood from the following description, when read in conjunction with the accompanying drawings in which:

FIG. 1 represents an isometric operational view of the present invention 10. Hands of user are received by first receptacle 24 and second receptacle 26.

Figure 2:
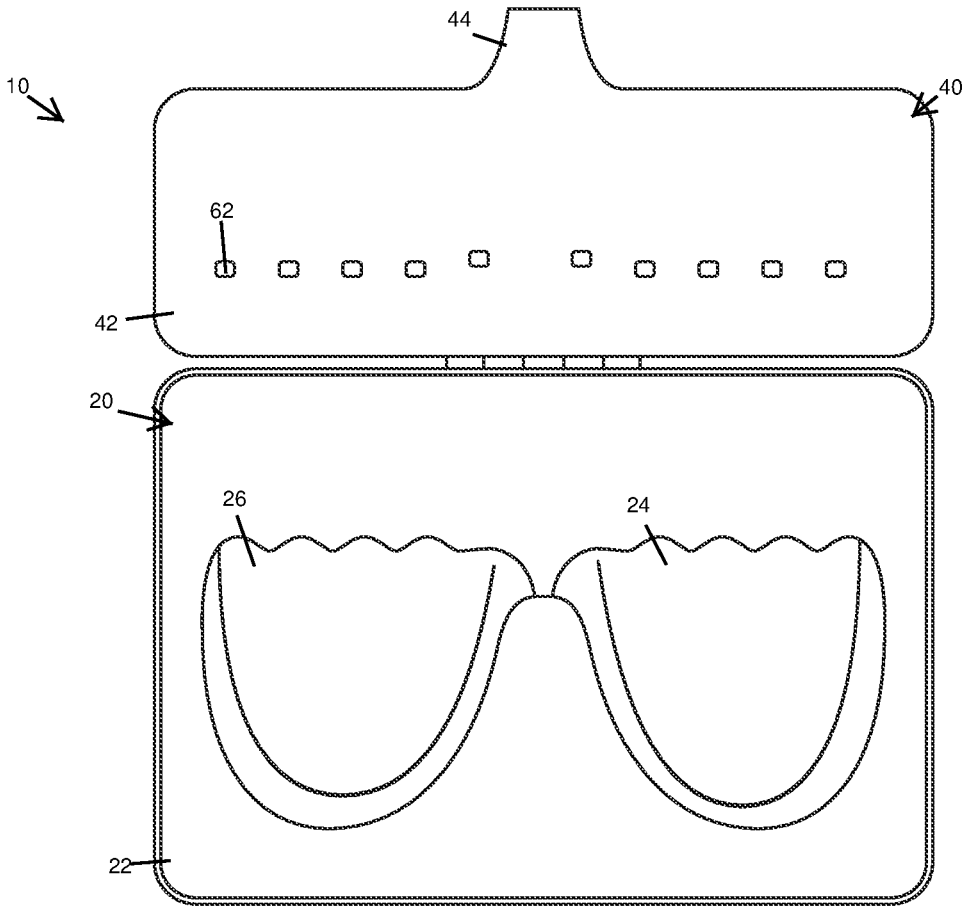

FIG. 2 top view of the present invention 10 showing an opened configuration. Door 42 is opened showing a plurality of lights 62 mounted to an internal side of the door 42.

Figure 3:
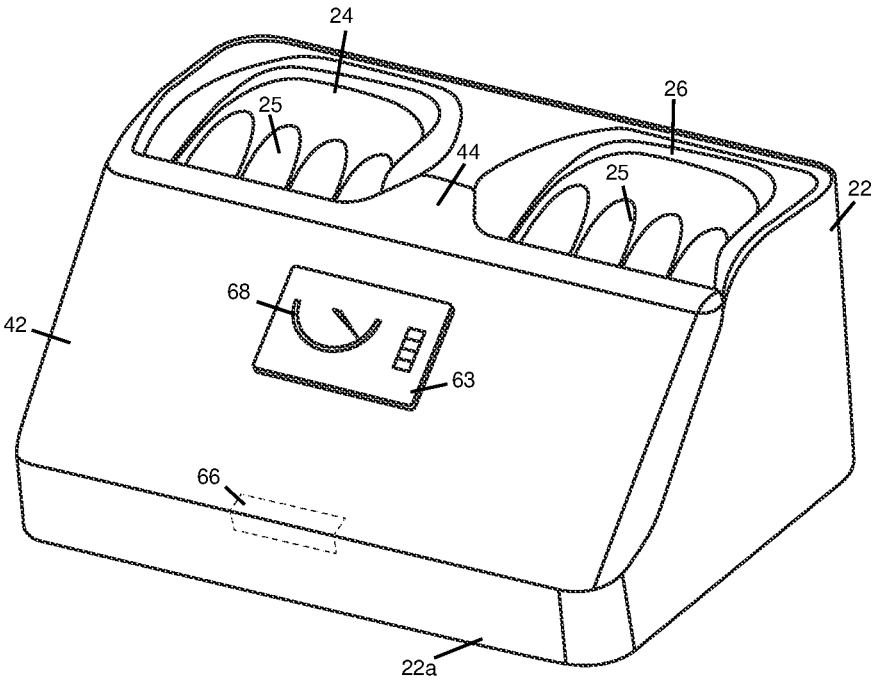

FIG. 3 illustrates an isometric view of the present invention 10 showing a closed configuration. Display 63 is located on front side of door 42.

Figure 4:
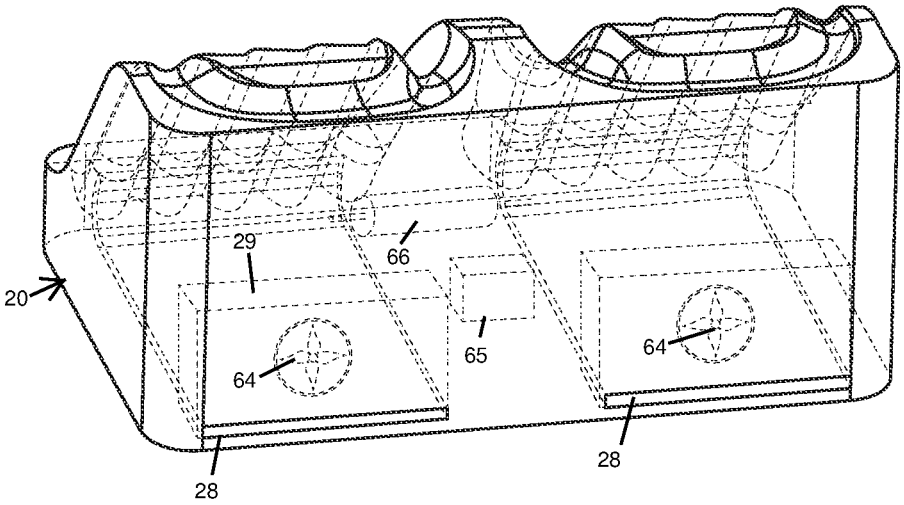

FIG. 4 is a representation of a see-through view of the housing assembly 20 showing vents 28, at least one fan 64 battery 65 and motor 66.

V. DETAILED DESCRIPTION OF THE EMBODIMENTS OF THE INVENTION

Referring now to the drawings, where the present invention is generally referred to with numeral 10, it can be observed that it basically includes a housing assembly 20, a door assembly 40 and an electrical assembly 60. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The housing assembly 20 includes a housing 22. In one embodiment, the housing 22 may have a base 22*a* having a substantially rectangular shape with rounded corners. It also may be suitable to have the base 22*a* having a circular shape, an oval shape or any other shape. Housing 22 may be made of plastic, carbon fibers, a metal, or any other resistant material. The housing 22 may have a rear wall having a substantially rectangular shape with lateral edges being rounded connecting lateral walls. An upper front portion of the housing 22 may have an inclination. The housing 22 may include a first receptacle 24 and a second receptacle 26. The first receptacle 24 may be defined as a first cavity within the upper front portion of the housing 22 and top side of the housing 22. The second receptacle 26 may be defined as a second cavity within the upper front portion of the housing 22 and top side of the housing 22. First receptacle 24 and second receptacle 26 may be separated by a protruding portion of the housing 22. The first receptacle 24 may have depth configured to receive first hand of user. The second receptacle 26 may have depth configured to receive second hand of user. First receptacle 24 and second receptacle 26 may include tubular cavities for receiving fingers of user. First receptacle 24 and second receptacle 26 may include indentation for fingers. First receptacle 24 and second receptacle 26 may be ergonomic.

Best observed in FIG. 4, the housing 22 may include vents 28. Vents 28 may be a cut from rear wall of housing 22 to tip portion of first receptacle 24 and second receptacle 26. Vents 28 may communicate first receptacle 24 and second receptacle 26 with outside of housing 22. It also may be suitable to have the vents 28 communicating any other outer portion of housing 22 with interior of first receptacle 24 and second receptacle 26. Vents 28 may include a fan cavity 29. Fan cavity 29 may have a rectangular shape. It also may be suitable to have fan cavity 29 having any other shape.

The door assembly 40 includes door 42. Door 42 may have substantially rectangular shape with rounded corners. Door 42 may have any other shape such as circular shape, elliptical shape, oval shape or the like. Door 42 may include a tab 44. Tab 44 may be located on upper edge of door 42. Tab 44 may have an inclination respect to door 42. Door 42 may be hingedly attached to upper front portion of base 22*a* of the housing 22. Door 42 may partially cover first receptacle 24 and second receptacle 26. Door 42 may be configured to be closed over fingers of user.

The electrical assembly 60 includes a plurality of lights 62 and a display 63. Plurality of lights 62 may be located on interior side of door 42. Plurality of lights 62 may be located in such a way that when door 42 is closed the plurality of lights 62 cover only fingernails of first hand and second hand of user for drying the fingernails. Plurality of lights 64 may have a substantially rectangular shape. It also may be suitable to have plurality of lights 64 having an oval shape, elliptical shape or any other shape. Plurality of lights 64 may be ultraviolet light-emitting diodes. In a preferred embodiment, display 63 may be located on a middle portion of front side of door 42. It also may be suitable to place display 63 anywhere else on the housing 22 or on the door 42. Display 43 may provide information of timing, mode of drying or intensity of drying. Dial 68 may be provided on display 63. Dial 68 may set timer, mode of drying or intensity of drying. Motor 66 may automatically close or open door 42. First receptacle 24 and second receptacle 26 may detect hands to activate motor 66 for closing door 42. Timer set by dial 68 may indicate motor 66 to open door 42.

Electrical assembly 60 may further include at least one fan 64 embedded on fan cavity 29. At least one fan 64 may blow air from outside housing 22 to first receptacle 24 and second receptacle 26 via the vents 28. Air blown by at least one fan 64 may dry fingernails of user. Electrical assembly 60 may further include battery 65. Battery 65 may be embedded within housing 22. Battery 65 may be a rechargeable battery. Battery 65 may provide electrical power to electrical assembly 60. Dial 68 may select mode of drying. Mode of drying may be with plurality of lights 62 or with air blown by at least one fan 64 or with plurality of lights 62 combined with air blown by at least one fan. Plurality of lights 62 provide light only to fingernails to safely dry gel from fingernails of user. Modes of drying of present invention 10 are safer and prevent user from diseases.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A fingernail dryer consisting of:

A) a housing assembly including a housing having a first receptacle and a second receptacle, said first receptacle and said second receptacle are defined as a cavity within an upper side and a front portion of the housing, said front portion has an inclined shape, wherein said housing further includes vents communicating said first receptacle and said second receptacle with an outside of the housing, said vents include a fan cavity, said first receptacle and second receptacle are configured to receive hands of a user therein;

B) a door assembly including a door, said door being hingedly mounted to the housing, said door being configured to partially cover the hands of the user; and C) an electrical assembly including at least one fan, a plurality of lights, a motor, a battery, and a display, said plurality of lights are UV LEDs, said plurality of lights are located on an interior side of the door, said plurality of lights are configured to be directed towards fingernails of user to dry fingernails gel, said at least one fan is located within said fan cavity, said at least one fan provides air to an interior of the first receptacle and the second receptacle, said display is located on a front portion of said door, said display includes a dial configured to set a timer for activation of the plurality of lights or the at least one fan, said motor actuates a hinge of the door to alternatively and automatically close or open said door, said battery is embedded within the housing, said battery provides electrical power to the electrical assembly.

* * * * *